US008845152B2

(12) United States Patent
Butler et al.

(10) Patent No.: US 8,845,152 B2
(45) Date of Patent: Sep. 30, 2014

(54) POLE MOUNTED ENCLOSURES FOR LUMINAIRES

(75) Inventors: Doyle Scott Butler, Dunwoody, GA (US); Ormand Gilbert Anderson, Jr., Woodstock, GA (US)

(73) Assignee: ABL IP Holding LLC, Conyers, GA (US)

( * ) Notice: Subject to any disclaimer, the term of this patent is extended or adjusted under 35 U.S.C. 154(b) by 414 days.

(21) Appl. No.: 13/246,895

(22) Filed: Sep. 28, 2011

(65) Prior Publication Data

US 2013/0077327 A1 Mar. 28, 2013

(51) Int. Cl.

| | |
|---|---|
| ***F21S 8/00*** | (2006.01) |
| ***F21V 23/02*** | (2006.01) |
| ***F21V 21/06*** | (2006.01) |
| *F21S 8/08* | (2006.01) |
| *F21W 131/103* | (2006.01) |
| *F21V 15/00* | (2006.01) |

(52) U.S. Cl.

CPC .. *F21V 21/06* (2013.01); *F21S 8/08* (2013.01); *F21V 23/023* (2013.01); *F21W 2131/103* (2013.01); *F21V 15/005* (2013.01)

USPC ..... 362/431

(58) Field of Classification Search

CPC ..... F21W 2131/103; F21V 21/116

USPC ..... 362/431

See application file for complete search history.

(56) References Cited

U.S. PATENT DOCUMENTS

| | | | |
|---|---|---|---|
| 1,349,478 | A | 8/1920 | Sugimura |
| 1,696,934 | A | 1/1929 | Allen |
| 2,456,179 | A | 12/1948 | Finer |
| 3,679,891 | A | 7/1972 | Quack |
| 3,683,172 | A | 8/1972 | Noyes |
| 3,976,986 | A | 8/1976 | Zabroski |
| 4,020,858 | A | 5/1977 | Wilson |
| 4,166,601 | A | 9/1979 | Kato |
| 4,174,532 | A | 11/1979 | Kelley |
| 4,200,906 | A | 4/1980 | Santilli |
| 4,225,909 | A | 9/1980 | Scholz et al. |
| 4,264,945 | A | 4/1981 | Ullman |
| 4,319,312 | A | 3/1982 | deVos et al. |
| 4,425,602 | A | 1/1984 | Lansing |

(Continued)

FOREIGN PATENT DOCUMENTS

| | | |
|---|---|---|
| EP | 0240066 | 10/1987 |
| EP | 0490647 | 6/1992 |

(Continued)

OTHER PUBLICATIONS

Rechargeable Umbrella Light, Product No. 18916 (item no longer available); http://www.frontgate.com/jump.jsp?item=18916&maincatcode_1&subcatcode=null&itemType=PRODUCT&path=1%2C2%2C145%2C799&iProductID=510; Admitted Prior Art.

(Continued)

*Primary Examiner* — Sean Gramling

(74) *Attorney, Agent, or Firm* — Kilpatrick Townsend & Stockton, LLP

(57) ABSTRACT

Enclosures for housing the electrical components of a luminaire at the base of a pole. In some embodiments, the enclosure is formed by two enclosure halves that are positioned around the base of the pole and mated together to form the enclosure.

19 Claims, 10 Drawing Sheets

(56) References Cited

U.S. PATENT DOCUMENTS

| | | | | |
|---|---|---|---|---|
| D283,647 | S | 4/1986 | Schumann | |
| 4,600,979 | A | 7/1986 | Fisher et al. | |
| D285,010 | S | 8/1986 | Mullins | |
| 4,729,076 | A | 3/1988 | Masami et al. | |
| 4,751,398 | A | 6/1988 | Ertz, III | |
| 4,787,019 | A | 11/1988 | van den Broeke | |
| 4,847,741 | A | 7/1989 | Boettinger | |
| 5,007,811 | A | 4/1991 | Hopkins | |
| 5,062,028 | A | 10/1991 | Frost et al. | |
| 5,105,350 | A | 4/1992 | Tolman et al. | |
| 5,134,550 | A | 7/1992 | Young | |
| 5,152,601 | A | 10/1992 | Ferng | |
| 5,426,574 | A | 6/1995 | Carolfi | |
| 5,584,564 | A | 12/1996 | Phyle | |
| 5,704,580 | A * | 1/1998 | Peery, Jr. | 248/345 |
| D391,384 | S | 2/1998 | Lerch | |
| D391,657 | S | 3/1998 | Compton | |
| 5,832,675 | A | 11/1998 | Zuares | |
| D402,386 | S | 12/1998 | Compton | |
| 5,911,499 | A | 6/1999 | Stafford et al. | |
| 5,963,178 | A | 10/1999 | Jones | |
| 6,053,621 | A | 4/2000 | Yoneda | |
| D426,010 | S | 5/2000 | Compton | |
| 6,256,961 | B1 * | 7/2001 | Byrnes | 52/835 |
| 6,257,557 | B1 | 7/2001 | Anderson et al. | |
| 6,337,792 | B1 * | 1/2002 | George | 361/674 |
| 6,392,563 | B1 | 5/2002 | Paquette et al. | |
| D468,472 | S | 1/2003 | Mullally et al. | |
| D475,801 | S | 6/2003 | Stewart | |
| 6,682,204 | B2 | 1/2004 | Mullally et al. | |
| D488,879 | S | 4/2004 | Brown et al. | |
| 6,769,509 | B2 | 8/2004 | Harwood | |
| 6,778,093 | B2 | 8/2004 | Harwood | |
| D497,447 | S | 10/2004 | Yoneda | |
| 6,876,152 | B2 | 4/2005 | Jeon et al. | |
| 6,899,444 | B1 | 5/2005 | Biber et al. | |
| 7,034,466 | B2 | 4/2006 | Tsao | |
| 7,041,899 | B2 | 5/2006 | Stekelenburg | |
| 7,178,952 | B2 | 2/2007 | Bucher et al. | |
| 7,196,477 | B2 | 3/2007 | Richmond | |
| D542,454 | S | 5/2007 | Chan | |
| 7,219,873 | B2 | 5/2007 | Harwood | |
| D558,908 | S | 1/2008 | Waedeled | |
| D564,687 | S | 3/2008 | Bucher et al. | |
| D567,424 | S | 4/2008 | St-Pierre et al. | |
| 7,690,613 | B2 | 4/2010 | Bowman et al. | |
| 7,851,702 | B2 | 12/2010 | Fournier et al. | |
| 8,029,151 | B2 | 10/2011 | Butler | |
| 2002/0149929 | A1 | 10/2002 | Evans et al. | |
| 2002/0191391 | A1 | 12/2002 | Van Etten | |
| 2004/0105264 | A1 | 6/2004 | Spero | |
| 2005/0117326 | A1 | 6/2005 | Ma | |
| 2005/0285011 | A1 | 12/2005 | Harwood | |
| 2006/0092646 | A1 | 5/2006 | Kelly et al. | |
| 2007/0070628 | A1 | 3/2007 | Chen | |
| 2007/0159834 | A1 | 7/2007 | Chen | |
| 2007/0211461 | A1 | 9/2007 | Harwood | |
| 2007/0247840 | A1 | 10/2007 | Ham | |
| 2008/0030988 | A1 | 2/2008 | Williams | |
| 2008/0080162 | A1 | 4/2008 | Wilcox et al. | |
| 2009/0244881 | A1 * | 10/2009 | Butler | 362/20 |

FOREIGN PATENT DOCUMENTS

| | | |
|---|---|---|
| EP | 0836368 | 4/1998 |
| JP | 2006196316 | 7/2006 |
| WO | WO00/59268 | 10/2000 |

OTHER PUBLICATIONS

E-Light Indoor/Outdoor Entertainment Light; Product No. 28334;. http://www.frontgate.com/mercadoSearch.do?action=search &newSearch=true&freeText=28334; Admitted Prior Art.

Avalon Rechargeble Umbrella Light; Product No. 28422; http://www.frontgate.com/mercadoSearch.do?action=search &newSearch=true&freeText=28422; Admitted Prior Art.

Office Action for Canadian Application No. 2,753,624, mailed Dec. 17, 2013 (2 pages).

Office Action for Canadian Application No. 2,787,910, mailed Jan. 7, 2014 (2 pages).

Office Action for Mexican Application No. 22191, mailed Apr. 1, 2014 (4 pages).

* cited by examiner

POLE MOUNTED ENCLOSURES FOR LUMINAIRES

FIELD

Embodiments of the present invention relate to pole mounted enclosures for electrical components that power light sources in luminaires.

BACKGROUND

Pole mounted luminaires are used in a variety of outdoor applications to illuminate parking lots, parks, sidewalks, etc. Such luminaires include one or more light sources (e.g., HID lamps, fluorescent lamps, light emitting diodes, etc.) that provide the desired illumination. Traditional pole mounted luminaires house the electronic components (ballast, driver, etc.) that supply power to such light source(s) either in the luminaire at the top of the pole or within the pole itself, rendering it difficult to access and service such components.

SUMMARY

Certain embodiments of the present invention provide enclosures for housing the electrical components of a luminaire at the base of a pole. In some embodiments, the enclosure is formed by two enclosure halves that are positioned around the base of the pole and mated together to form the enclosure.

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

BRIEF DESCRIPTION OF THE FIGURES

Illustrative embodiments of the present invention are described in detail below with reference to the following drawing figures.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Figure 1:
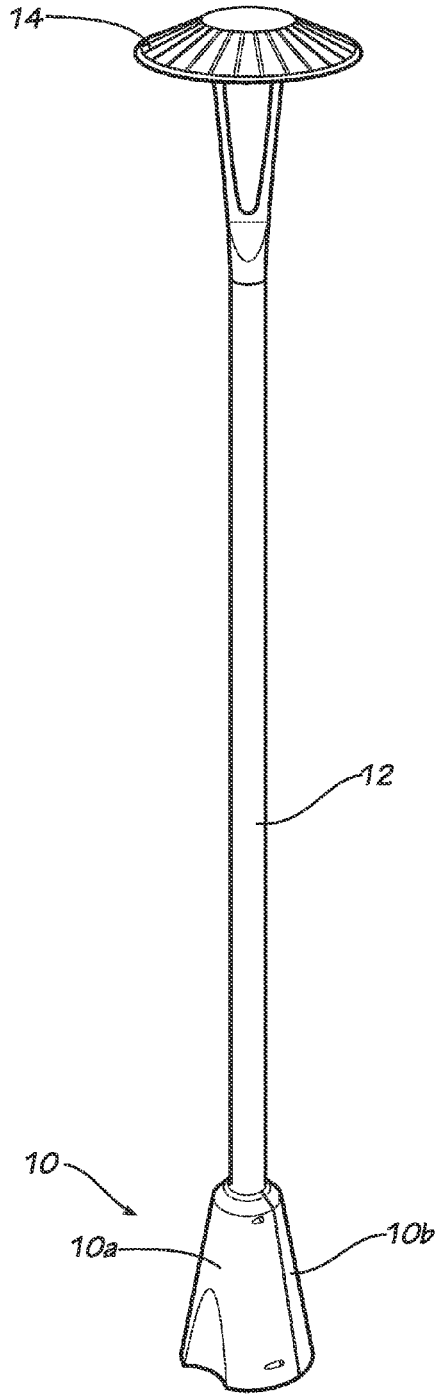
FIG. 1 is a top perspective view of an embodiment of an enclosure positioned on a luminaire pole.
Figure 2:
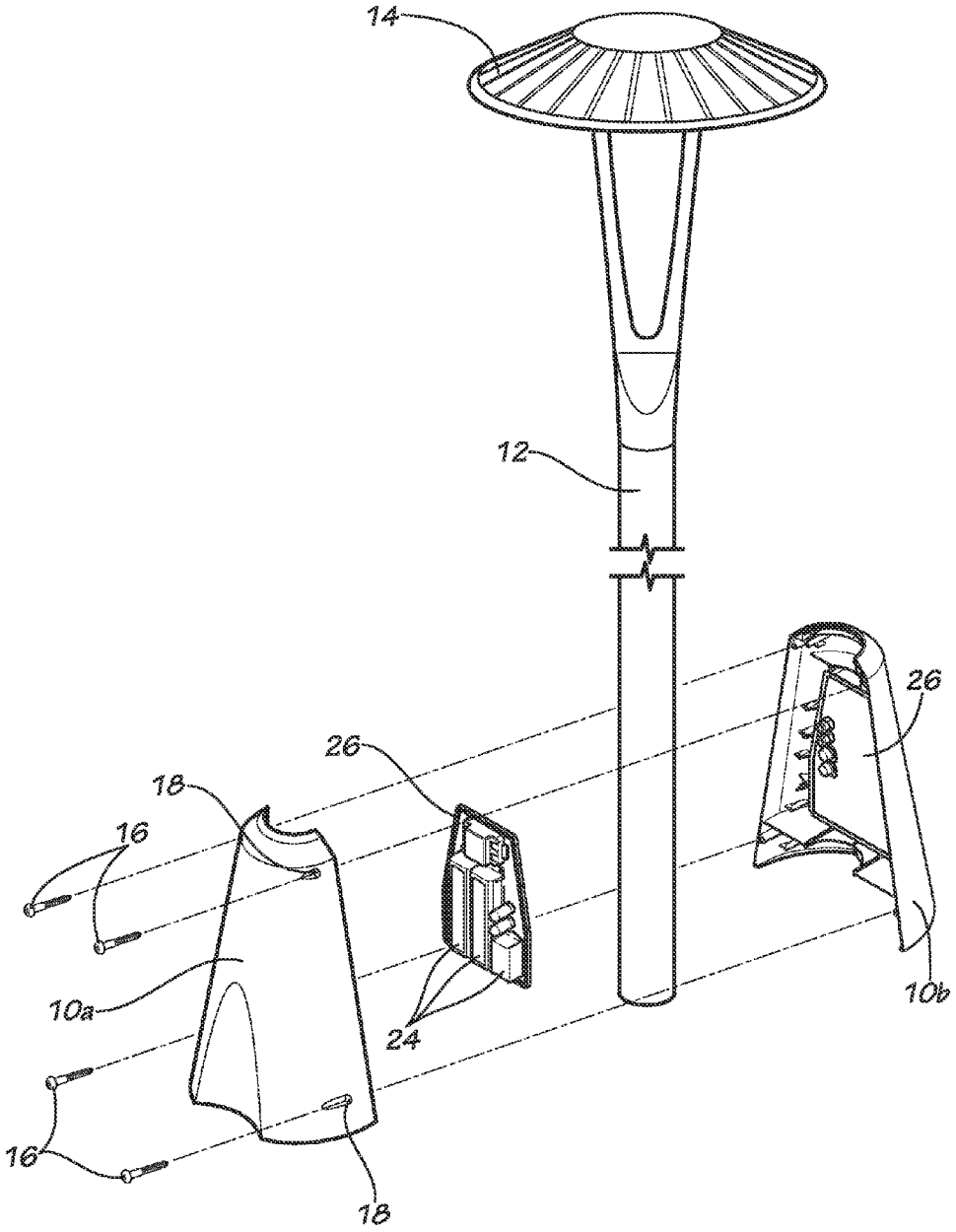
FIG. 2 is an exploded view of an embodiment of an enclosure positioned around a luminaire pole.

Certain embodiments of the present invention provide an enclosure for positioning around a luminaire pole, such as at the base of the pole, and in which electrical components of the luminaire (e.g., drivers, ballasts, batteries, etc.) are stored. FIG. 1 shows an embodiment of an enclosure 10 positioned around a luminaire pole 12 that supports a luminaire 14, which, in turn, houses at least one light source (not shown), such as but not limited to LEDs. Embodiments of the enclosure 10 described herein may be used with poles 12 of any shape and are not restricted to use with circular poles. Moreover, the exterior shape of the enclosure 10 can vary from what is illustrated herein and can be designed and tailored to compliment the style or aesthetics of the luminaire.

The enclosure 10 preferably is formed of two enclosure halves 10*a*, 10*b* that are positioned on each side of the pole 12 and mated together to form the enclosure 10 at the base of the pole 12. In some embodiments, the enclosure halves 10*a*, 10*b* are secured in a non-permanent fashion so that they can be removed from each other. By way only of example, the enclosure halves 10*a*, 10*b* may be secured together via tamper resistant screws 16 that are inserted into apertures 18 located in each enclosure half 10*a*, 10*b*.

The enclosure halves 10*a*, 10*b* may be formed from any material having suitable strength and integrity, including metallic and polymeric materials. In some embodiments, the enclosure halves 10*a*, 10*b* are cast from aluminum.

In some embodiments, the enclosure halves 10*a*, 10*b* are identical but do not have to be. At least one interior wall 20 is provided on at least one enclosure half 10*a*, 10*b* to define a compartment 22 sized and shaped to accommodate electrical components 24 for powering the light source(s) in the luminaire 14. The number of interior walls 20 will depend on the desired shape of the compartment 22. In some embodiments, the electrical components 24 are simply positioned within the compartment 22 and a door (not shown) is secured over the compartment 22 to retain the components 24 within the compartment 22. In other embodiments, the electrical components 24 are mounted on a power tray 26 which is positioned adjacent the compartment 22 so that the electrical components 24 mounted thereon are enclosed within the compartment 22.

Figure 3A:
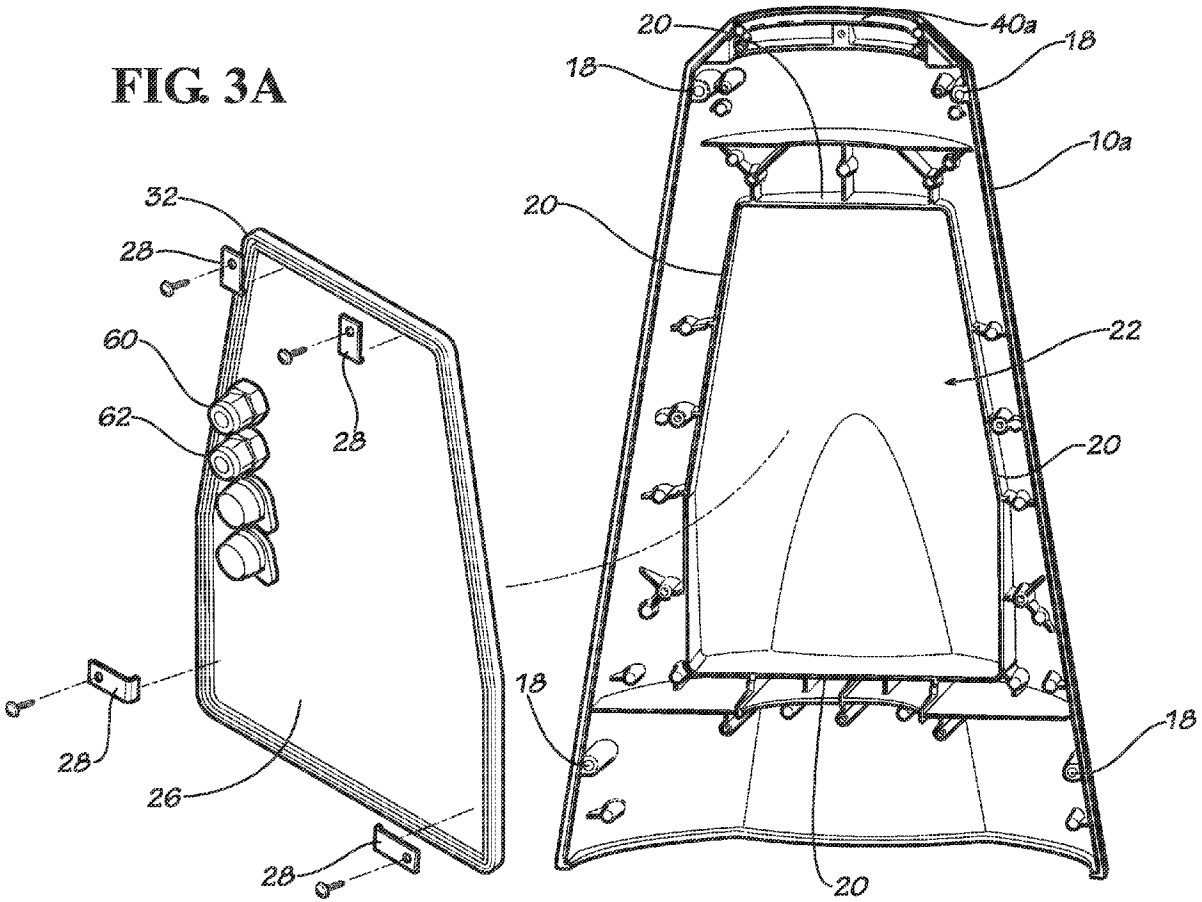
FIG. 3A is a front perspective view of an embodiment of an enclosure half in isolation with a power tray exploded from the enclosure half.
Figure 3B:
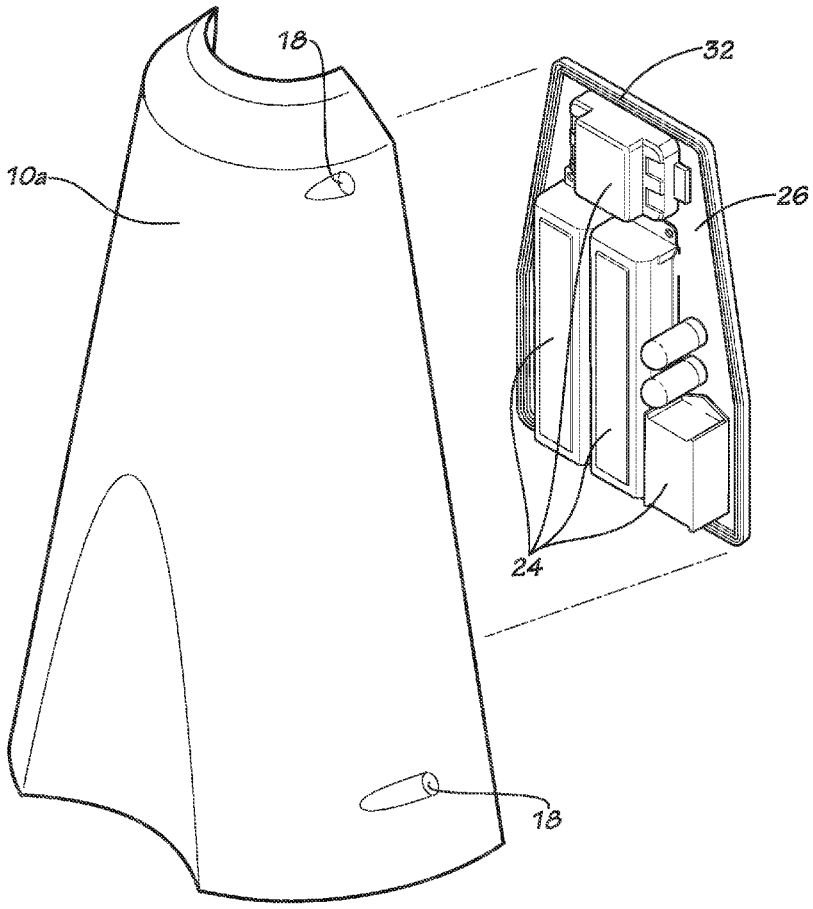
FIG. 3B is a rear perspective view of the enclosure half of FIG. 3A in isolation with the power tray exploded from the enclosure half.
Figure 4:
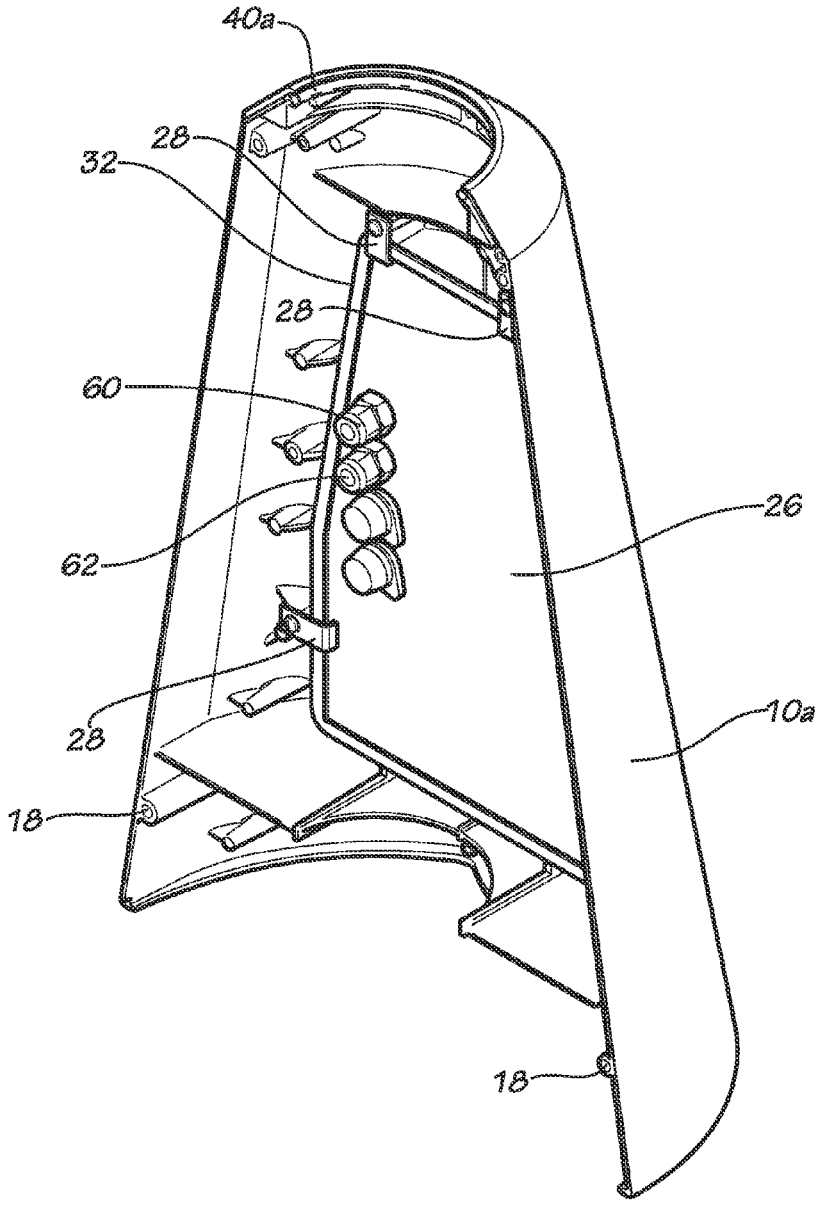
FIG. 4 is a perspective view of an embodiment of an enclosure half with a power tray retained on the enclosure half.

In some embodiments, the power tray 26 is mounted on the enclosure half 10*a*, 10*b* so that it can be removed to permit replacement of the power tray 26 (with associated electrical components 24) or replacement or servicing of the electrical components 24 contained on the power tray 26. Any mechanical retention method may be used. In the illustrated embodiment, rotatable clips 28 (see FIGS. 3A and 4) are positioned on the enclosure half 10*a*, 10*b*. The clips 28 can be rotated so that they engage the power tray 26 and thereby retain the power tray 26 in position to enclose the compartment 22. The clips 28 can be further rotated so that they disengage from the power tray 26, thereby permitting its removal. A gasket 32 may be provided around the perimeter of the power tray 26 to seal the interface where the power tray 26 and interior wall 20 come together and thereby render the compartment 22 watertight.

In some embodiments, the interior of both enclosure halves 10*a*, 10*b* are provided with a compartment 22. A power tray 26 can be provided on one or both enclosure halves 10*a*, 10*b*.

Figure 5:
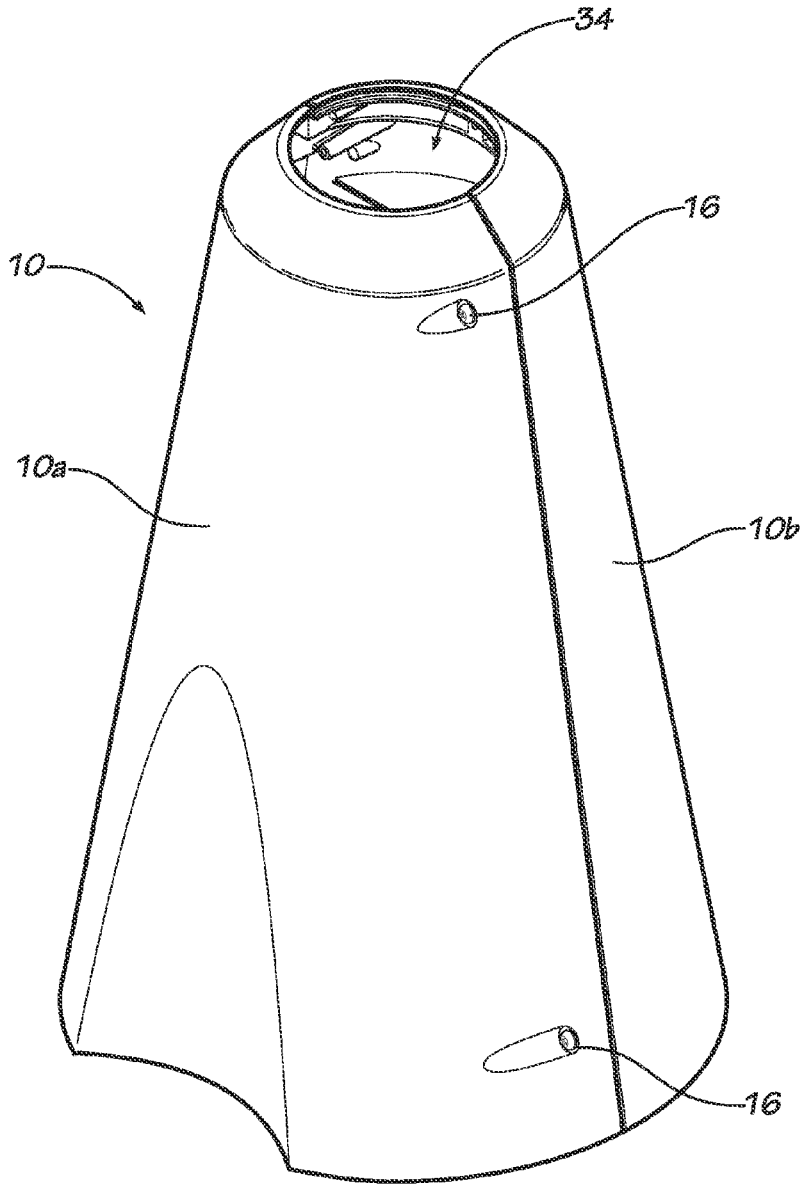
FIG. 5 is a perspective view of two enclosure halves mated together to form an enclosure according to an embodiment.

When the two enclosure halves 10*a*, 10*b* are coupled together (see FIG. 5), an enclosure pole aperture 34 is formed through the enclosure 10. The pole 12 is located in the enclosure pole aperture 34 when the enclosure 10 is in situ on the pole 12.

Figure 6:
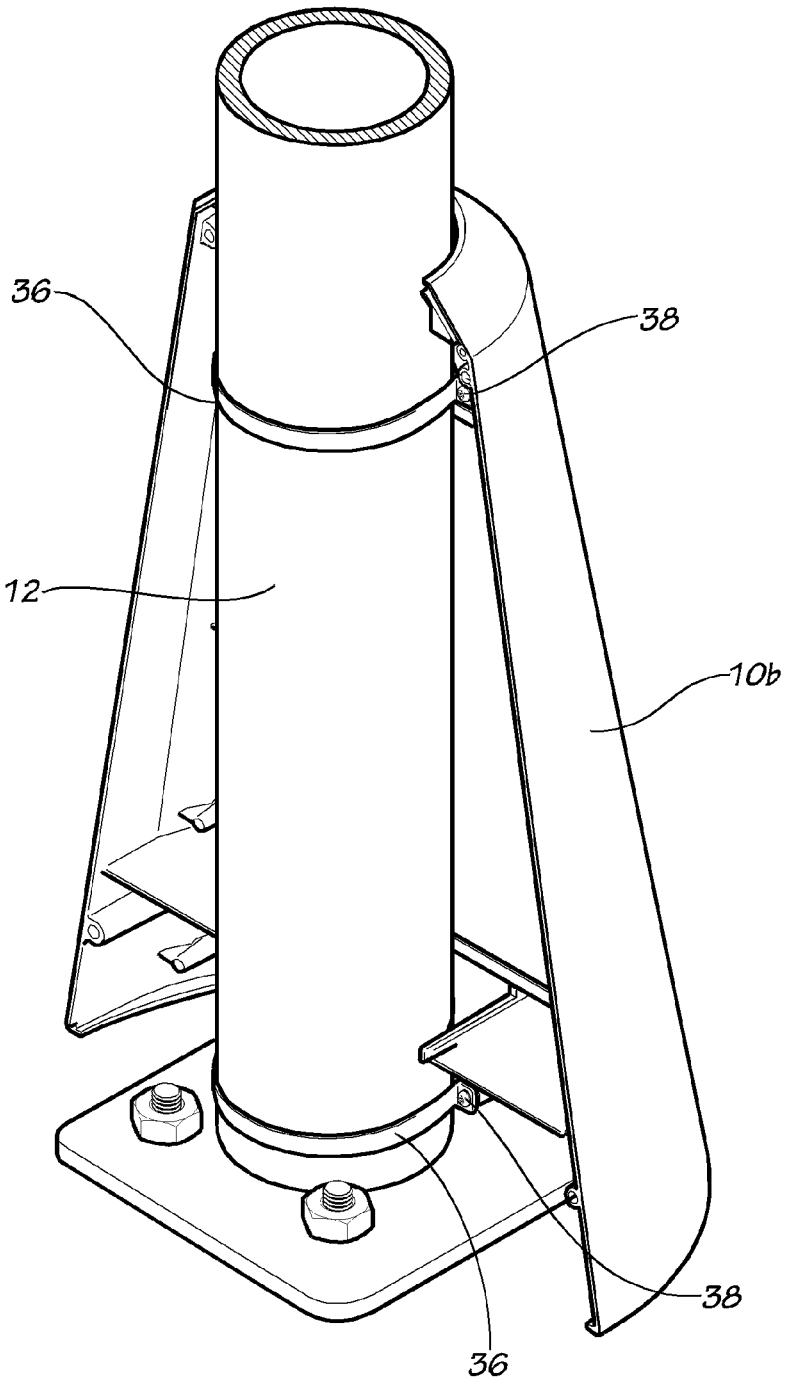
FIG. 6 is a perspective view of an enclosure half strapped to a pole.

In some embodiments, the enclosure pole aperture 34 is sized to fit the diameter of the pole 12. In such situations, the enclosure halves 10*a*, 10*b* may be mounted directly on the pole 12. In some embodiments, the enclosure halves 10*a*, 10*b* are mounted simply by aligning the enclosure halves 10*a*, 10*b* around the pole 12 and securing them together. In other embodiments, one of the enclosure halves 10*a*, 10*b* is mounted directly to the pole 12. By way only of example, straps 36 may be used to secure one of the enclosure halves 10*a*, 10*b* to the pole 12. While two straps 36 are shown in FIG. 6, any number of straps 36 may be used. A strap 36 extends around the pole 12 and attaches to the enclosure half 10*a*, 10*b*, such as via screws 38 inserted into aligned screw apertures located in both the strap 36 and the enclosure half 10*a*, 10*b*. Note that it may not be desirable to mount an enclosure half 10*a*, 10*b* directly to the pole 12 (with straps 36 or otherwise) if the enclosure half 10*a*, 10*b* includes a power tray 26, as such mounting may render it more difficult to service the power tray 26. However, it is certainly contemplated herein to do so.

In some embodiments, an enclosure gasket segment 40*a*, 40*b* is positioned in each enclosure half 10*a*, 10*b* proximate the enclosure pole aperture 34. Collectively, the enclosure gasket segments 40*a*, 40*b* prevent water from entering the enclosure 10 through the pole enclosure 34 when the enclosure 10 is positioned on the pole 12. Moreover, in some embodiments, a lip 42 (see FIG. 7) extends from one side of each enclosure half 10*a*, 10*b*. When the enclosure halves 10*a*, 10*b* are mated, the lips 42 span the seam where the two enclosure halves 10*a*, 10*b* mate to thereby prevent rain from entering the enclosure 10 through the seams.

In some embodiments, the enclosure pole aperture 34 of the enclosure 10 is larger than the diameter of the pole 12 on which the enclosure 10 is to be positioned. In such cases, an adapter 44 may be used to narrow the size of the enclosure pole aperture 34 of the enclosure 10 and thereby accommodate poles of different diameters. More specifically, the adapter 44 has an adapter pole aperture 30 having a diameter smaller than that of the enclosure pole aperture 34 such that the adapter 44 narrows the size of the enclosure pole aperture 34 when seated in the enclosure pole aperture 34.

Figure 7:
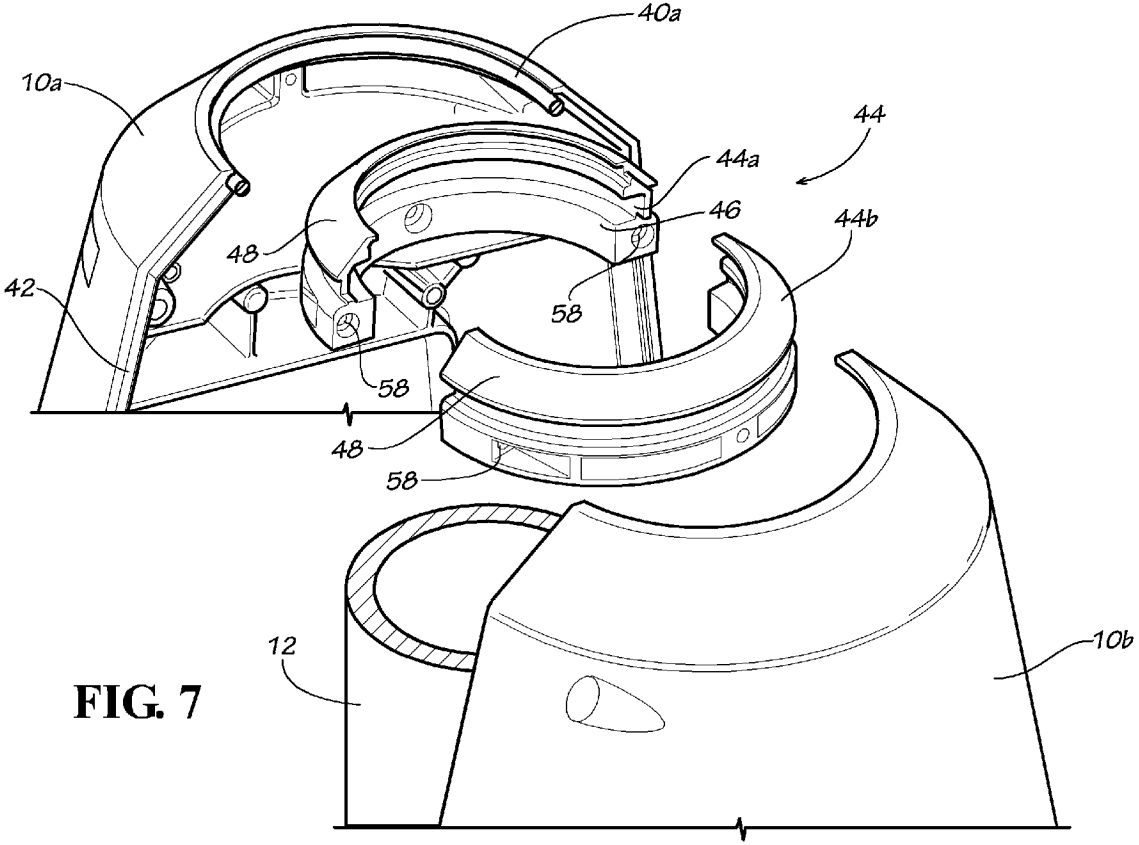
FIG. 7 is an exploded view of enclosure halves with adapter halves according to an embodiment.
Figure 8:
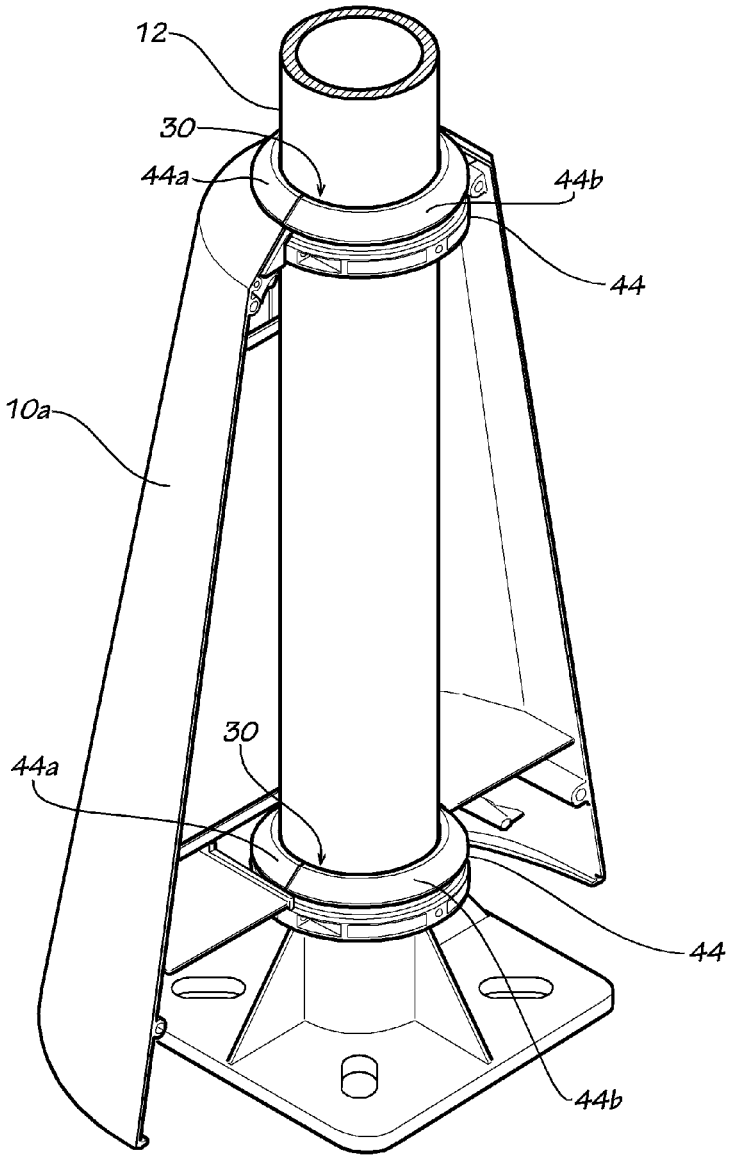
FIG. 8 is a perspective view of adapters positioned around a pole and an enclosure halve positioned on the adapters according to an embodiment.
Figure 9A:
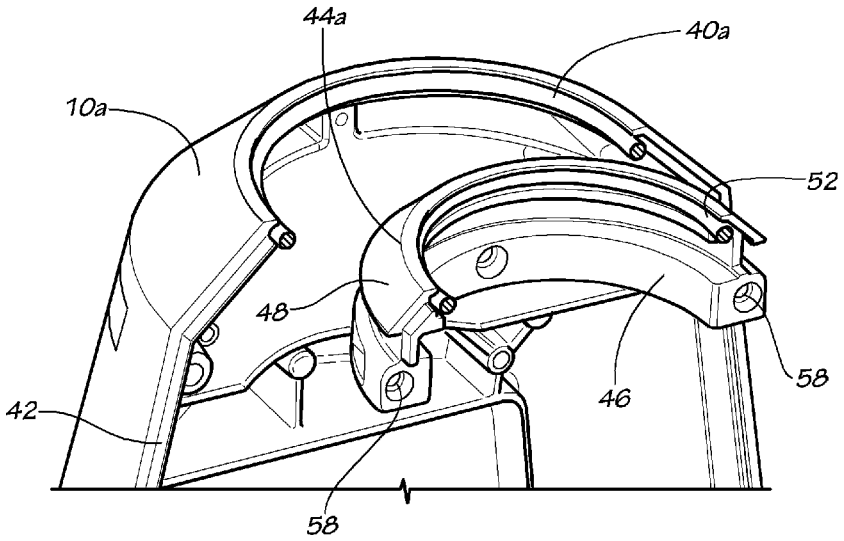
FIG. 9A is an exploded view of an adapter half and an enclosure half according to an embodiment.
Figure 9B:
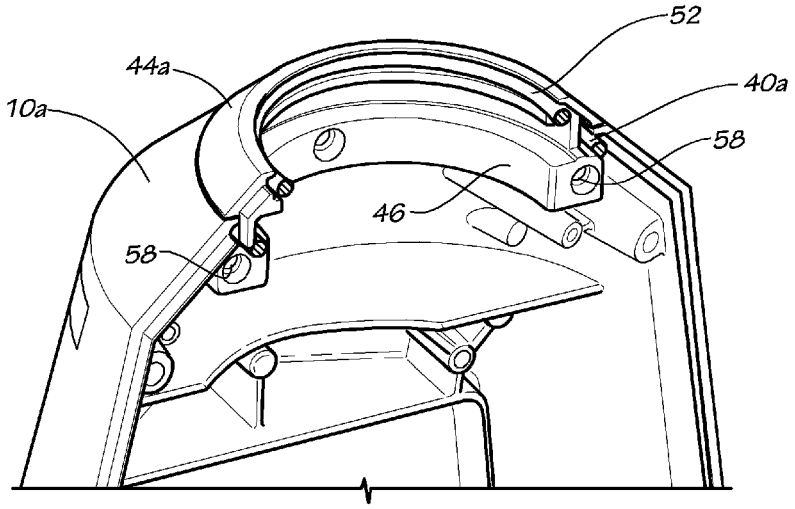
FIG. 9B is a perspective view of the adapter half of FIG. 9A seated in the enclosure half of FIG. 9A.

In some embodiments, the adapter 44 is formed of two adapter halves 44*a*, 44*b* that mate to form the adapter 44 that extends around the pole (see FIGS. 7-9). The illustrated embodiments show use of two adapters 44 with the enclosure 10. However, any number of adapters 44 (including a single adapter) may be used.

The adapter halves 44*a*, 44*b* may be formed from any material having suitable strength and integrity, including metallic and polymeric materials. In some embodiments, the adapter halves 44*a*, 44*b* are cast from aluminum.

In some embodiments, the adapter halves 44*a*, 44*b* are identical but do not have to be. Each adapter half 44*a*, 44*b* has an inner surface 46 and an outer surface 48. The inner surface 46 can be shaped to conform to the pole 12. The inner surface 46 may (but does not have to) also include a recess for receiving an adapter gasket segment 52 (see FIGS. 9A and 9B), which, when the adapter halves 44*a*, 44*b* are secured around the pole 12, prevent water from entering the enclosure 10 between the adapter 44 and the pole 12.

The outer surface 48 can be any shape. In some embodiments, the interior of the enclosure half 10*a*, 10*b* is shaped to complement the outer surface 48 of an adapter half 44*a*, 44*b*. In some embodiments, it may be desirable to secure the adapter half 44*a*, 44*b* directly to the enclosure half 10*a*, 10*b*, such as with screws (not shown). Although, if the enclosure half 10*a*, 10*b* includes a power tray 26, securing the enclosure half 10*a*, 10*b* to the adapter half 44*a*, 44*b* can render it more difficult to remove the enclosure half 10*a*, 10*b* and service the power tray 26 mounted thereon.

Different adapters 44 may be provided to accommodate poles 12 of different diameters. In use, the adapter(s) 44 may first be mounted on the pole 12. The adapter halves 44*a*, 44*b* of each adapter 44 may be aligned about the pole 12 and secured together using any suitable mechanical retention method. In some embodiments, the adapter halves 44*a*, 44*b* are clamped around the pole 12 to create a compression fit on the pole 12. By way only of example, each adapter half 44*a*, 44*b* may include adapter apertures 58. The adapter halves 44*a*, 44*b* of an adapter 44 are positioned on the pole 12 so that their adapter apertures 58 align. The adapter apertures 58 of one adapter half 44*a*, 44*b* may be fitted with nuts (not shown) that receive screws (not shown) inserted through the adapter apertures 58 of the other adapter half 44*a*, 44*b*. However, other methods for securing the adapter halves 44*a*, 44*b* to each other around the pole 12 would certainly be readily known and contemplated by one of ordinary skill in the art.

After the adapter(s) 44 is positioned on the pole 12, the enclosure halves 10*a*, 10*b* are positioned around the pole 12 and secured together, as discussed above. Each enclosure half 10*a*, 10*b* receives an adapter half 44*a*, 44*b* of at least one adapter 44 (and perhaps more if more than one adapter 44 is used, as shown in FIG. 8). When so positioned, the enclosure gasket segments 40*a*, 40*b* are positioned between the adapter halves 44*a*, 44*b* and the enclosure halves 10*a*, 10*b*. Thus, the adapter gasket segments 52 prevent water from entering the enclosure 10 between the adapter 44 and the pole 12 and the enclosure gasket segments 40*a*, 40*b* prevent water from entering the enclosure 10 between the enclosure halves 10*a*, 10*b* and the adapter 44*a*, 44*b* halves.

The power tray(s) 26 is fed power by leads coming up from the pole 12 through the hand hole in the pole 12. The power leads are coupled to the power tray 26 (such as via a "power-in" connector 60) to supply power to the electrical components 24 mounted on the power tray 26. Power exits the power tray via a "power-out" connector 62. An extender harness (not shown) is coupled to the connector 62 and extends into the hand hole and up to the luminaire 14 on top of the pole 12 to thereby power the light sources in the luminaire 14.

Use of embodiments of the above-described enclosure 10 permit easy access to power trays 26 for servicing and/or replacement. To access a power tray 26, the enclosure halves 10*a*, 10*b* are simply de-coupled and the power tray 26 removed from the enclosure half 10*a*, 10*b*. Moreover, inclusion of the electrical components 24 within the enclosure 10 allows for luminaires having thinner profiles or smaller heads. The enclosure 10 disclosed herein may be provided on new poles 12 or retro-fitted on existing poles 12.

The foregoing is provided for purposes of illustrating, explaining, and describing embodiments of the present invention. Further modifications and adaptations to these embodiments will be apparent to those skilled in the art and may be made without departing from the scope or spirit of the invention. Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

We claim:

1. An enclosure adapted to be positioned at a bottom of a pole that supports a luminaire distal the bottom of the pole, the enclosure comprising:

a first and second enclosure half removably coupled to define an enclosure pole aperture adapted to receive the pole, wherein the first enclosure half comprises at least one interior wall that defines a compartment; and a power tray mounted on the first enclosure half and supporting at least one electrical component, wherein the power tray is removably mounted over the compartment of the first enclosure half to enclose the at least one electrical component within the compartment, the power tray further comprising a power-in connector for connection to power leads coming up the pole and a power-out connector for supplying power to a light source located within the luminaire.

2. The enclosure of claim 1, wherein the first and second enclosure halves are identical.

3. The enclosure of claim 1, wherein the second enclosure half comprises at least one interior wall that defines a compartment and wherein a power tray is removably coupled over the compartment of the second enclosure half.

4. The enclosure of claim 1, wherein the power tray is removably mounted over the compartment via rotatable clips.

5. The enclosure of claim 1, wherein the power tray comprises a perimeter and a gasket provided around the perimeter of the power tray.

6. The enclosure of claim 1, wherein each of the first and second enclosure halves comprises a gasket segment proximate the enclosure pole aperture.

7. The enclosure of claim 6, wherein the gasket segments are adapted to prevent water from entering the enclosure through the enclosure pole aperture when the enclosure is positioned on the pole.

8. The enclosure of claim 1, further comprising an adapter positioned within the enclosure pole aperture, wherein the enclosure pole aperture has a diameter and the adapter comprises an adapter pole aperture having a diameter less than the diameter of the enclosure pole aperture.

9. The enclosure of claim 8, wherein, in use, the adapter is adapted to be interposed between the pole and the enclosure.

10. The enclosure of claim 9, wherein the adapter comprises a first adapter half for engaging the first enclosure half and a second adapter half for engaging the second enclosure half.

11. The enclosure of claim 8, wherein the adapter comprises a gasket adapted to prevent water from entering the enclosure between the adapter and the pole.

12. A method of mounting an enclosure to the bottom of a pole having a base and supporting a luminaire distal the bottom of the pole, the enclosure comprising:

(i) a first and a second enclosure half removably coupled to define an enclosure pole aperture adapted to receive the pole, wherein the first enclosure half comprises at least one interior wall that defines a compartment; and (ii) a power tray mounted on the first enclosure half and supporting at least one electrical component, wherein the power tray is removably mounted over the compartment of the first enclosure half to enclose the at least one electrical component within the compartment, the power tray further comprising a power-in connector for connection to power leads coming up the pole and a power-out connector for supplying power to a light source located within the luminaire, the method comprising:

a. electrically connecting the light source to the power tray;

b. positioning the first enclosure half and the second enclosure half around the base of the pole; and c. securing the first and second enclosure halves together.

13. The method of claim 12, wherein positioning the second enclosure half around the base of the pole comprises strapping the second enclosure half to the pole.

14. The method of claim 12, further comprising positioning at least one adapter around the pole prior to positioning the first and second enclosure halves around the pole.

15. The method of claim 14, wherein the at least one adapter comprises a first adapter half and a second adapter half, wherein positioning the at least one adapter comprises attaching the first adapter half to the second adapter half to form a compression fit on the pole.

16. The method of claim 15, wherein positioning the first and second enclosure halves around the base of the pole comprises positioning the first enclosure half around the first adapter half and the second enclosure half around the second adapter half so that the at least one adapter is interposed between the pole and the enclosure at the enclosure pole aperture.

17. A method of servicing a luminaire comprising a pole having a base and a bottom, a luminaire mounted on the pole distal the bottom of the pole and having at least one light source, and an enclosure positioned at the bottom of the pole that houses at least one electrical component for powering the at least one light source, the enclosure comprising:

(i) two enclosures halves removably coupled to define an enclosure pole aperture adapted to receive the base of the pole, wherein at least one of the enclosure halves comprises at least one interior wall that defines a compartment; and (ii) an existing power tray mounted on the first enclosure half and supporting the at least one electrical component, wherein the existing power tray is removably mounted over the compartment of the at least one enclosure half to enclose the at least one electrical component within the compartment, the existing power tray further comprising a power-in connector for connection to power leads coming up the pole and a power-out connector for supplying power to the at least one light source, wherein the method comprises:

a. removing the at least one enclosure half;

b. removing the existing power tray from the at least one enclosure half; and c. re-coupling the two enclosure halves around the base of the pole.

18. The method of claim 17, further comprises providing a new power tray and, after removing the existing power tray, removably mounting the new power tray over the compartment of the at least one enclosure half prior to re-coupling the two enclosure halves around the base of the pole.

19. The method of claim 17, further comprising, after removing the existing power tray, replacing or servicing the at least one electrical component on the existing power tray and removably mounting the existing power tray over the compartment of the at least one enclosure half prior to re-coupling the two enclosure halves around the base of the pole.

* * * * *